US005102724A

United States Patent [19]

Okawahara et al.

[11] Patent Number: 5,102,724

[45] Date of Patent: Apr. 7, 1992

[54] TWO-WAY STRETCH FABRIC AND METHOD FOR THE PREPARATION THEREOF

[75] Inventors: Tsuneo Okawahara, Sakai; Yugoro Masuda, Takatsuki, both of Japan

[73] Assignee: Kanebo, Ltd., Tokyo, Japan

[21] Appl. No.: 315,891

[22] PCT Filed: Jun. 9, 1988

[86] PCT No.: PCT/JP88/00558

§ 371 Date: Jan. 31, 1989

§ 102(e) Date: Jan. 31, 1989

[87] PCT Pub. No.: WO88/09838

PCT Pub. Date: Dec. 15, 1988

[30] Foreign Application Priority Data

Jun. 10, 1987 [JP] Japan ..... 62-144250

[51] Int. Cl.[5] ..... D03D 15/04; D04H 1/42; D06C 7/00

[52] U.S. Cl. ..... 428/224; 26/18.5; 28/155; 28/247; 428/370

[58] Field of Search ..... 26/18.5; 28/155, 247; 428/231, 370, 374, 224

[56] References Cited

FOREIGN PATENT DOCUMENTS 70012 4/1986 Japan .

*Primary Examiner*—James C. Cannon
*Attorney, Agent, or Firm*—Morgan & Finnegan

[57] ABSTRACT

A lengthwise and crosswise stretchable fabric comprising bicomponent polyester filaments produced by conjugate spinning in side-by-side relationship component (A), a polyethylene terephthalate copolymerized with a structural unit having a metal sulfonate group, and component (B), a polyethylene terephthalate or polybutylene terephthalate. The fabric is rendered stretchable by inducting crimps in the bicomponent filaments thereof through exposure to infrared rays while said filaments are in a relaxed condition. The filaments may have been mechanically crimped prior to being formed into the fabric.

8 Claims, 5 Drawing Sheets

TWO-WAY STRETCH FABRIC AND METHOD FOR THE PREPARATION THEREOF

TECHNICAL FIELD

The present invention relates to a stretch fabric prepared by using a conjugate fiber and a method for the preparation thereof.

BACKGROUND OF THE INVENTION

A two-way stretch fabric prepared by polyurethane elastic fibers has been known. However, the fabric has problems in heat resistance, light resistance, chemical resistance, dyeing property and fungus resistance as disadvantages of the polyurethane material. Further, since the stretching property is based on a rubber-like elasticity, its stretching rate reaches to as high a value as not lower than 400%, but a stress value for the stretching rate when the stretching property is practical in use is rather high and thus it gives a tight clamp of rubber-like elasticity which limits its application.

Further, in order to obtain a two-way stretch non-woven fabric, a non-woven fabric of loose tissue with little enveloping of the fiber coated with a natural rubber latex also is known. However, the non-woven fabric has a low stretching rate lower than 9% and has a disadvantage of forming texture slipage in use and of being broken.

Additionally, a non-woven fabric prepared by a procedure in which a crimping treatment is applied on polyamide fibers, and webs are formed using them, and then they are resin-treated, is known. However, the stretching is limited to the lateral direction and the stretching rate is also as low as lower than 9%.

Japanese Laid-Open Patent Publication No. 168159 of 1974 discloses non-woven fabrics having a high elastic recovery and a soft feeling, which are prepared by point-bonding with a fibrous polymer (C) having a low melting point a web comprising an eccentric sheath & core conjugate fiber produced with two components, 5-sulfo-isophthalic acid copolymerized polyester (A) and polybutyrene terephthalate (B).

On the other hand, side by side conjugate fibers have been used to produce wadding, raw stock for quilting and the like, woven fabrics, knitted fabrics, bulky yarns for handcraft, non-woven fabrics and the like. For example, Japanese Laid-Open Patent Publication No. 80561 of 1980 discloses raw stock for wadding prepared with conjugate fibers in which differences of sulfonic acid group comprised in the polymer are at least 0.4 mol % and low angle scattering strength of X-rays is less than 15, and further discloses in the examples acrylic conjugate fiber produced by a side by side method in which differences of sulfonic acid group are 0.2 to 1.5 mol %. Japanese Laid-Open Patent Publication No. 70012 of 1986 discloses polyester conjugate fibers having a specific heat shrinkage which are produced by eccentrically bonding polyester (A) copolymerized with a metal sulfonate group of 3 to 6 mol % and polyester (B), and further exemplifies a stretch non-woven fabric produced by blending a polyester fiber having a low melting point in the conjugate fiber. However, each of them does not teach a two-way stretch fabric produced by using side by side conjugate fibers.

As described above, a fabric, which has enough two-way stretching ability, a low stress for the stretching rate and further has a stretching property of soft follow-up property, has not been available.

Accordingly, an object of the present invention is to provide a fabric which has a low stress for the stretching rate and has a soft and following-up stretching property and also has an excellent dyeing property in a commercial scale production.

DISCLOSURE OF THE INVENTION

The present invention has accomplished the above-mentioned object by utilizing the three dimensional crimping property of a special conjugate fiber and the fabric of the present invention is characterized by comprising a polyester conjugate fiber in an amount of at least 30 weight %, which is prepared by conjugate spinning a polyethylene terephthalate (component A) copolymerized with a structural unit having a metal sulfonate group in a ratio of 1.5 to 6.0 mol % and a polyethylene terephthalate or polybutylene terephthalate (component B) in side by side method and drawing the product.

The conjugate fiber is comprised in the fabric in the state of having a birefringence of $90\times10^{-3}$ to $195\times10^{-3}$ and being three dimensionally crimped so that said fabric has a stretching rate in both the longitudinal direction and the lateral direction within the following percentage range:

$$9 \leqq \frac{L_2 - L_1}{L_1} \times 100 \leqq 160$$

wherein $L_1$ is the vertical length of the specimen of a definite length and 5 cm wide when loaded by 5 g weight and $L_2$ is the vertical length of said specimen when loaded by a given weight, which is 240 g when said fabric is non-woven fabric and 1500 g when said fabric is woven or knitted fabric.

The component A of the polyester conjugate fiber used in the present invention can be prepared by a procedure in which an ester forming compound having a metal salt sulfonate group such as 5-Na-sulfo-isophthalic acid, 5-K-sulfo-isophthalic acid, 5-Li-sulfo-isophthalic acid, 4-Na-sulfo-phthalic acid, 4-Na-sulfo-2,6-naphthalene dicarboxylic acid or an ester-forming derivative thereof is added to the polyethylene terephthalate manufacturing process in a ratio of 1.5 to 6.0 mol %, preferably 2.0 to 5.5 mol %, and then copolymerized. A small amount of other components also may be copolymerized or blended if necessary.

Further, the component B is a polyethylene terephthalate or polybutylene terephthalate. A small amount of other components may also be copolymerized or blended if necessary.

The polyester conjugate fiber can be prepared by combining side by side the component A and the component B and conjugate spinning and drawing it. However, in the case it contains less than 1.5 mol % of the unit of the component A having metal salt sulfonate group, the three dimensional crimping by the heat treatment is reduced and the stretching property of the product becomes insufficient. On the other hand, when it contains more than 6.0 % of the unit, both the fiber strength and the melting point are lowered to cause practical disadvantages.

The fabric of the present invention can be prepared by the procedure in which a raw fabric containing such conjugate fiber in a ratio of not less than 30 weight % is prepared and then heat-treated to give enough three dimensional crimping to the above mentioned conjugate fiber of the whole fabric in both the longitudinal and lateral directions. However, it is important to effect the heat treatment of the raw fabric by an irradiation of far-infrared rays under a relaxed condition of the raw fabric.

It is necessary to use conjugate fibers prepared by conjugate spinning and subsequent drawing which have a molecular orientation structure having a birefringence in the range of $85\times10^{-3}$ to $190\times10^{-3}$, preferably $90\times10^{-3}$ to $175\times10^{-3}$, measured by using tricresyl phosphate as the dipping solution. Conjugate fibers having a birefringence of less than $85\times10^{-3}$ or more than $190\times10^{-3}$ can not provide a fabric superior in stretching property by the heat treatment.

As the birefringence of the conjugate fiber may be somewhat enhanced by the heat treatment, the conjugate fiber having the birefringence in the above mentioned range provides a fiber having a birefringence in the range of $90\times10^{-3}$ to $195\times10^{-3}$ in the fabric product.

The polyester conjugate fiber, which has a latent three dimensional crimp peculiar to a conjugate fiber to suppress the bulkiness, mechanically crimped in appearance and heat-treated to shift the temperature at which the three dimentional crimp starts to a higher level, is preferably used as the raw material for the preparation of cross web, random web and spinning yarn.

Namely, as the conjugate fiber prepared by conjugate spinning and subsequent drawing, there is preferably used that which is heat treated under tension at 140° to 170° C. to give a practical linear shrinkage of 0.5 to 5% and mechanically crimped to give a crimpness of 8~13/inch, preferably 9~11/inch.

The raw fabric of the present invention may contains not less than 30 weight % of the polyester conjugate fiber. Known fibers such as natural fibers, semisynthetic fibers and synthetic fibers may be mixed at a ratio of 70~0 weight % to the 30~100 weight % of said conjugate fiber. It is impossible to give a fabric having a longitudinal stretching rate of not lower than 9% at a mixing ratio of the polyester conjugate fiber of lower than 30 weight %.

Among the fibers which may be used together with the polyester conjugate fiber for preparing the fabrics, there are included cotton, wool, down, linen ramie, silk, viscose rayon fiber, acetate fiber, polyamide synthetic fiber, polyester synthetic fiber, polyacrylonitrile synthetic fiber, polyethylene fiber, polypropylene fiber, polyvinyl alcohol synthetic fiber, polyvinyl chloride fiber, polyvinylidene chloride fiber, polyurethane fiber, a binder fiber containing hot melt components, glass fiber, carbon fiber, natural pulp, synthetic pulp and the like. A slit film may be used.

The process for preparing raw fabrics is different for non-woven fabrics and woven or knitted fabric.

The raw non-woven fabric is prepared by mixing these raw materials in a defined ratio and blending and opening the mixture to form a web. The effective methods for web formation include carding process, Garnet process, air lay process and the like. Furthermore, the resultant cross web and random web may be prebonded by a needle punch process or spun race process, processed by stitch bond process or applied with an acrylic resin and the like by spraying or immersing process.

Further, the non-woven fabric may be prepared by a wet process with use of short cut fibers of 5 to 10 mm.

Contrary to it, woven and knitted fabrics are prepared by using the spun yarn made by a procedure in which the above mentioned materials are mixed in a defined ratio, opened, carded, drafted and then subjected to a known spinning process such as ring spinning, open-end spinning, air-jet spinning and the like. The spun yarn is a latent conjugate crimped yarn with no stretching and accordingly can be very easily woven or knitted. It is important for the design of gray woven fabric with use of the spun yarn that the void percentage of the yarn arrangement defined by the following equation is made to be at least 45%, preferably not lower than 50% in both the warp and weft directions. The void percentage of lower than 45% does not produce good stretch fabric. Especially, it is important for the preparation of the stretch fabric having no seam-slipping property to set the above-mentioned void percentage in the range of 53 to 72%.

$$\text{void percentage} = \left(1 - \frac{0.034}{\sqrt{N \cdot S}} \times P\right) \times 100$$

where

N: English count converted to single fiber

S: Density of the spun yarn (g/cm$^2$)

P: Punching density/inch. (The number is counted under the condition of a loading weight of 1500 g to 5 cm of the fabric in each of the warp and weft directions.)

The fabric of the present invention can be made into a product having a stretching rate of at least 9% by a procedure in which the polyester conjugate fiber as mentioned above is shrunk by the development of firm three dimensional crimping (number of crimps: 30~50/inch) by heat treatment and converted to a coiled shape with which other components are involved.

A fabric having a stretching property only in the longitudinal direction can be continuously manufactured by heat-treating a raw fabric as mentioned above with a known hot air drier, short loop steamer or hot air shrink drier at an appropriate temperature. However, it is possible to continuously manufacture a fabric having a uniform stretching rate of at least 9% in both of the longitudinal and lateral directions by the application of the conventional heat treating equipment and conditions as described above.

Thus, the present invention makes it possible to manufacture fabrics having a uniform high stretching rate in both directions by a procedure in which the raw fabric is shrunk in both the longitudinal and lateral directions in a heat treating zone in consequence of which the raw fabric is fed to the heat treating zone in a relaxed state so that the raw fabric can move in both directions following the shrinking force, at the same time applying far infrared radiation in the heat treating zone.

First, the heat source will be discussed in detail. As the polyester conjugate fiber used in the present invention has a heat shrinking property and a heat set property, it is preferred to give the heat shrinkage in as low a temperature range as possible, because the heat set property is enhanced in a high temperature region to involve the effect even of a weak tension and to give an insufficient shrinkage. This is especially important for the longitudinal shrinkage of the fabrics.

A heat treatment in which hot air or steam as the heat source is directly blown to the raw fabric provides a shrinkage starting temperature of 100° C. and a shrinkage completing temperature of 200° C. This phenomenon is caused by the fact that heat is given to the interior of the polyester conjugate yarn of low thermal conductivity by heat transfer and convection. The period required is thus as long as 30 sec. at 180° C. Further, the definite cause of failure is that the hot air pressure or the steam pressure gives tension to the raw fabric and the heat set progresses under the tension so that a sufficient shrinkage can not be attained.

Contrary to it, in the case far-infrared ray is used as the heat source, the shrinkage starting temperature is lowered to 64° C. which is the secondary transition point of the polyester conjugate fiber, and the shrinkage completing temperature becomes 160° C. The period required is only 10 sec. at 160° C. This is because the heat is given by direct radiation and far-infrared ray is absorbed to the interior of the polyester conjugate fiber with no medium. The wave length of far-infrared ray lies usually between 4 and 400 μm and the absorption wave length of the polyester conjugate fiber is present in the range of 5.7 to 15 μm. The fiber absorbs the far-infrared ray of this wave length and the molecular movement is generated to evolve the internal heating at the temperature not lower than the secondary transition point.

Accordingly, in the method of the present invention, it can be avoided to use the heat set temperature range of 170° to 200° C. commonly used for the polyester fiber and further shrinkage in both the longitudinal and lateral directions can be completed in a short period under a condition in which no tension is afforded to the fabric. The temperature at the radiation zone is necessary to ease the molecular movement for completing the shrinkage of the polyester conjugate fiber. In the case of non-woven fabric, it may be varied according to the raw material ratio in the raw fabric, the extent of needling, the resin inpregnation rate, the weight of the non-woven fabric and the like. In the case of woven fabric, it may be varied according to the blending ratio of spun yarn, the count of warp and weft and the like. In the case of knitted fabric, it may be varied according to the blending ratio of spun yarn, the size of stitch and the like.

In order to complete the full shrinkage, it is preferred to set the atmospheric temperature around the fabric at 80° to 110° C. for cross web and random web by carding process, at 90° to 130° C. for prepunched cross web, random web and raw knitted fabric, at 120° to 160° C. for full-punched cross web and random web, and at 120° to 160° C. for the raw non-woven fabric impregnated by 6% acrylic resin and raw woven fabric. The temperature can be controlled by adjusting the heat source on the back-side of the ceramic of the far-infrared ray generator. When the far-infrared ray is generated by electric power, it can be achieved by on-off control or by voltage control with a thyristor.

The time required for the completion of heat shrinkage may be only 10 to 15 sec. The fabric moves forward accompanied by a shrinking motion in both the longitudinal and lateral directions during irradiation by the far-infrared ray. It is preferred to adjust the initial radiation zone temperature to a level lower than the next irradiation zone temperature by about 10° C. so that it gets shrinkage in 2 or more steps, such as the first step and the second step, rather than to generate a large shrinkage at one step.

In the case of raw non-woven fabrics containing moisture previously, the drying and heat treatment for shrinkage can be realized at the same time.

Woven fabrics or knitted fabrics are treated by conventional process such as desizing, scouring, bleaching, dyeing and the like. Though the fabrics are thus heat-treated, they do not result in a good two-way stretch textile, because of receiving a longitudinal high tension in the above conventional process.

In the method of the invention, such a treated fabric is fed to the heat treating equipment of the invention as the raw woven fabric or the raw knitted fabric, in which the shrinkage by crimping is recovered. It is preferred to supply the raw fabric in wet condition so that the drying and the shrinkage are completed simultaneously.

Now, the relaxed condition will be described.

According to the present invention, the heat treatment is carried out by far-infrared ray irradiation. However, it is impossible to manufacture continuously on a commercial scale two-way stretch fabric only by the treatment.

It is important to maintain the whole raw fabric in a relaxed state so that the fabric can move in both the longitudinal and lateral directions following the shrinkage rate given in the heat treating zone for the irradiation by far-infrared ray. Especially, the followability in the longitudinal direction is important.

For the purpose, the fabric should be over-fed corresponding to the shrinkage. It is important that the over-feed and the relaxed state are realized in the longitudinal direction of the fabric in the heat treating zone.

Concretely, it is important that the contact area between the fabric and the lattice is small so that the dynamic friction during the shrinkage motion is low and that the fabric is fed to the heat treating zone under a relaxed state by forming a short loop in the fabric. A combination of these processes may be applied according to the weight of the objective fabric. It is difficult to decrease the contact area between the fabric and the lattice in the case of using hot air or steam as the heat source, which requires relatively long time for heat treatment. However, the far-infrared ray irradiation is very useful, because it decreases the heat treatment time, shortens the length of the heat treating and lowers the resistance against shrinkage due to the weight of the fabric and the zone length.

Further, it is also effective to use a bar type lattice or to use a grid type lattice of wide opening for decreasing the contact area.

To lower the dynamic friction during the shrinkage motion, a chromeplating or Teflon-coating may be applied on the bar or grid material, or a rotary bar may be used. Further, in the case of non-woven fabric, the shrinkage resistance due to the friction may be lowered by blending the polyester fiber surface-treated with silicone. Additionally, it is also effective to use a procedure in which a faint air stream is blown out of a multi-pore air nozzle bar fixed on the bootom of the lattice or a multi-pore air nozzle equipped on the lower far-infrared ray irradiation plate to float the fabric over the lattice surface and thus to lower the shrinkage resistance due to the self weight of the fabric, or a procedure in which air is sucked by a nozzle having suction holes between the upper far-infrared ray irradiation plate to float the fabric over the lattice surface by about 1 mm during the heat treatment.

These methods are effective because the far-infrared ray is a radiation having the straight-going and reflective properties through no heating medium. In this case, the terminal of a temperature sensor can be inserted to the vicinity of the ceramic body of the far-infrared ray irradiation plate to control the temperature. It is the most preferable method to feed the raw fabric in the state of forming a short loop to the heat treating zone.

Embodimently, a short loop may be formed while inserting the raw fabric mechanically between the lattice bars or while inserting the raw fabric between the lattice bars by air pressure blown out of the nozzle.

Alternately, a procedure may be effectively used in which the raw fabric is fed from the belt conveyor equipped to the upper surface of the grid lattice on the lattice and an air blow is applied on the fabric from the fixed multi-pore air nozzle in the lower part of the lattice to form a short loop on the lattice.

It shall be noticed that the short loop should be formed by using the over-feed portion of the raw fabric. Mechanical or pneumatic tension may be given to the short loop previously formed to form and keep the loop. However, it should be avoided to give a temperature of not lower than 70° C. to the fabric in this step.

It is also important that the tension on the fabric generated by the pneumatic force is reduced by cancelling as combined as possible.

The shape of the short loop is controlled by the distance between the upper and bottom lattice conveyors and the air flow rate, and the shape is set to match the over feed ratio depending on the shrinkability.

The fabric shrunk in the heat treating zone is cooled on the lattice on the discharge side and dropped in a truck and then wound.

The resultant two-way stretch fabric of the present invention is heat-settable and thus can be subjected to a weight adjustment and a stretching rate adjustement if required. For this purpose, it may be tentered to a required width or tensioned by minus feed while blowing hot air or steam to afford a dimension set continuously.

In this case, a temperature higher than that previously applied in the heat treating zone of the present invention may be applied on the fabric. For example, hot air may be blown on it at 180° C. for 4 sec. under tension. Alternately, it can be set by being pressed with a hot roller or a press machine.

In the case the stretch raw fabric of the present invention contains at least 60% of the polyester conjugate fiber and treated only in a dry state, it has a specific snacking property and shows a characteristic suitable for use in the B-face body of the velvet type fastener. This snacking property can be removed by using steam in the dimension set process mentioned above.

For example, it is suitable to blow steam at 120° C. for 3 sec.. Alternately, it may be heat treated under sprayed moisture, or it may be immersed in hot water at a temperature not lower than 70° C. and then squeezed by a roller and dried.

In the case a binder fiber containing hot melt components is blended in the raw non-woven fabric of the present invention to thermally bond, the low-melting components can be melted in the heat treating zone or the tentering heat set process of the present invention to complete the bonding.

The heat treatment of the present invention can be carried out continuously connecting to the preceeding process for the manufacture of the raw fabric and the succeeding heat set process and also handled as a separate process in the lap supply process.

It is preferable for the heat treatment of the present invention to be carried out by a horizontal lattice. However, it may be carried out by a lattice tilted forward, a lattice titled to the lateral direction or a vertical type.

Now, the properties and the applications of the stretch fabrics prepared by the present invention will be illustrated.

The stretch fabric of the present invention is a set fabric in which the shrinkage is completed to a stable form at the heat treating temperature or at a temperature not higher than the heat set temperature and has a stretching property which extends following softly even to a weak tension to any direction and also a soft elongation recovery owing to the strong three dimentional crimp. The stretching rate can be set between 9 and 160% at will according to the mixing ratio of the raw materials and the method for the preparation of raw fabric and the stretching recovery can be also set according to the mixing ratio of the raw materials and the method for the preparation of raw fabric.

Such a fabric of the present invention can be used for applications requiring no stretching recovery and also for those requiring high stretching recovery.

For example, in the case the fabric is used as the deep moulding surface material for the formation of a soft touch surface by adhering it on the uneven surface of plastics and on the surface of boxes, the stretching property is necessary but the stretching recovery may be not necessary.

In such a case, the fabric of the present invention has such a heat set property that it can be set at the state by being adhered on the substrate as the surface material and heated to a temperature higher than that of the heat treatment during its production and resultantly the stretching recovery can be removed to give an uniform surface on the substrate surface.

Contrary to it, the object can be efficiently achieved by using a raw non-woven fabric containing 5 to 35 weight %, preferably 6 to 25 weight % of a known low-melting fiber used for thermal bonding for applications in which a high stretching recovery and a rapid kick-back property with a low permanent set are required. In this case, a thermoplastic or thermoset three dimensional thermal bonding point is formed in the nonwoven fabric and, for example, the stretching recovery after 30 sec. can be set at 95 to 100%. And, the stretching rate also can be set in the range of 9 to 160%.

Furthermore, when an elastic nonwoven fabric having a longitudinal stretching rate of 9 to 15% and a lateral stretching rate of 35 to 45% is required, the object can be accomplished by a procedure in which a web is formed by mixing 40 to 50% of a known highly shrinkable non-annealed synthetic fiber and then it is punched to obtain a raw non-woven fabric.

Thus, as the fabric of the present invention has a two-way stretching property designed for each purpose and a soft touch fitness, it can provide products which gives no oppressive sensation nor resistance and which follows the movement of the body comfortably and gives good geel and which has excellent draping and fitting properties when used for clothings.

This advantage is based on the facts that the polyester conjugate yarn used for the present invention contains a cation-dyeable polyester as component A and thus it has a lower Young's modulus than a usual polyester, and that the birefringence of the polyester conjugate fiber is in the range of $90\times10^{-3}$ to $195\times10^{-3}$ as a result of the limitation of its increase by $5\times10^{-3}$ to $25\times10^{-3}$ and by heat-treating with far-infrared ray absorption and that a sufficient morphologic change realizing heat shrinkage and a high three dimensional crimp rate is attained.

Furthermore, the stretch fabric of the present invention can be used highly effectively for the following applications utilizing its characteristics.

(1) It has little nap on the surface and has an excellent anti-pill property. Accordingly, it can be efficiently punched out and cut. It can be used as a comfortable clothing material superior in elongation recovery, as a stretch padding cloth following the movement of the face material and giving no physical disorder, or a stretch base material for composite compresses which is used by coating various ointments or medicines. This effect is based on the facts that the heat treatment of the present invention gives the polyester conjugate fiber a full shrinkage so that the fiber winds spirally the other fibers simultaneously with the development of coiling to give a flat napless surface, that the internal fiber structure shows an orientation in which the birefringence of the polyester conjugate fiber after heat-treatment is limited within the range of $90\times10^{-3}$ to $195\times10^{-3}$ and that the single fiber strength is in the range of 1.8 to 3.8 g/d.

(2) The fabric of the present invention has an excellent stretching ability in both of the longitudinal and lateral directions and shows a high bulkiness with the high crimping property. The volume recovery of the fabric of the present invention after being heavily loaded is especially good and thus it maintains a high air content and shows a soft and high thickness. Accordingly, it can be used for soft clothing materials superior in stretching property and easily movable, such as underwear, winter sport wears, working clothes, winter clothes, operating gown and the like, and for stretching materials such as cushioning materials, padding materials for furniture, padding materials for seat, wipers, carpets, shock-absorbing padding materials for sports, joint tapes for medical care and the like.

(3) As the fabric of the present invention is superior in both of stretching and shrinking properties and has high density. Accordingly, it has an excellent filter property, and it is useful for masks, molded masks, filter clothes, air filters, filters for liquid and the like.

(4) As the fabric of the present invention has a high water-holding capacity and a high anti-wet back property in addition to the stretching property, it is suitable for liquid storage. It is useful for absorption paddings for oil separation, battery separators, menstrual napkins, dipers and the like.

(5) As the fabric of the present invention has a heat-setting property in addition to the stretching property in both directions, it can be partly deformed with a mould, heat-treated and shaped three dimensionally into several forms. It can be widely used for shoulder pad materials, core or interlining materials, basking materials, foundation materials and the like.

(6) As the fabric of the present invention is superior in heat resistance, light resistance and chemical resistance and also can be dyed to a deepcolor with cationic dyes and dispersion dyes even under atmosphereic pressure, it can be widely used for clothing and several decorative mats.

(7) As the fabric of the present invention is superior in stretching recovery and crease recovery, it can be used durably for mats or coverlets for a foot warmer, packaging materials and the like.

(8) The fabric of the present invention can be variously finished to produce useful products. They include a large cushion molding which is prepared by laminating the fabric comprising heat melting fibers, cutting the product, integrating several cut sheets and thermal rebonding in a mold, a synthetic leather superior in stretching property which is produce by impregnating or coating a styrene-butadiene synthetic latex or urethane synthetic latex, an elastic water-absorbing synthetic leather having a PVA-acetal film, and the like. Further, the non-woven fabric of the present invention can be further finished by such as needle-punching, impregnation with an acrylic resin, physical treatment with an embossing roller, compression molding with a press plate, laminating or needling with at least one of known non-woven fabrics, woven fabrics, knitted fabrics, films and papers on one side or on both sides or at both end.

(9) As the woven and knitted fabrics of the present invention are soft and superior in stretching property in all directions, and can be dyed with cationic dyes, they are useful for a material for sports wears such as tennis wears, baseball wears, ski wears and the like, working wears, trunks, shorts, shirts, interliner and the like.

BRIEF DESCRIPTION OF THE DRAWINGS

Each of FIGS. 1 to 4 is the flow diagram showing respectively one embodiment of the heat treating process according to the present invention.

BEST MODE OF EMBODYING THE INVENTION

Figure 1:
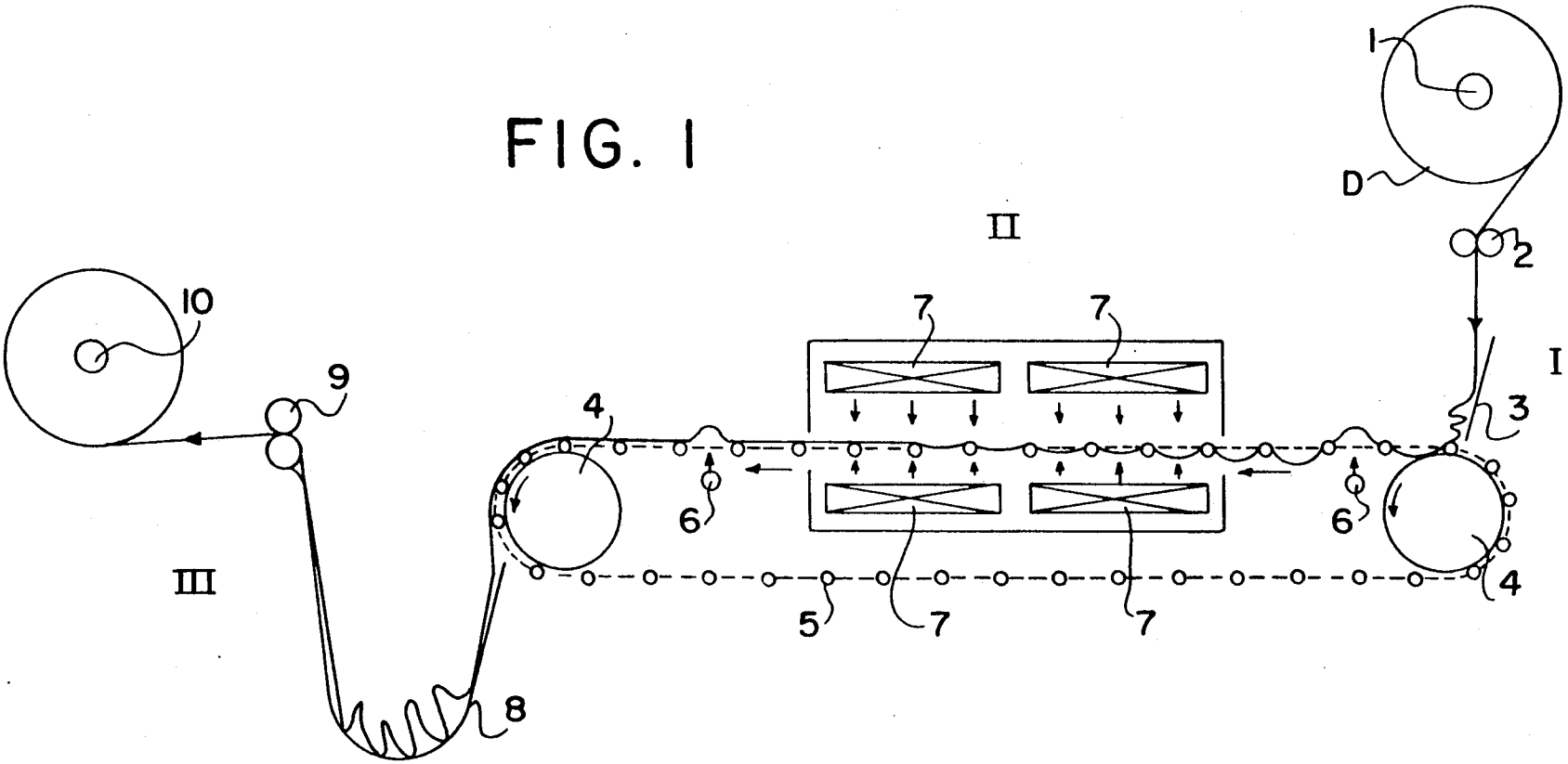

Now, the present invention will be illustrated in details by Examples. The methods for the measurement of the physical properties in Examples were in accordance with the followings.

(1) Intrinsic Viscosity [η]

The relative viscosity ($\eta_{rel}$) at 20° C. is measured using a mixed solvent containing equal weight of phenol and tetrachloroethane and the intrinsic viscosity is calculated by the following equation.

$$[\eta] = \frac{\sqrt{1 + 4K(\eta_{rel} - 1)}}{2KC} - 1$$

wherein coefficient K=0.37 and concentration C=1 g/100 cc.

(2) Stretching Rate and Stretching Recovery

The test is carried out with use of Tensilon in the condition of a sample clamping length of 10 cm, a sample width of 5 cm and a head speed of 5 cm/sec. The sample is elongated under an initial load of 5 g and stood for 1 min. to measure the vertical length $L_1$.

Then the sample which is a non-woven fabric is loaded with 240 g and stood for 1 min. to measure the vertical length $L_2$ and the load is released and the stress is relaxed for 3 min. Further the loading of 5 g is repeated and stood for 1 min. to measure the vertical length $L_3$. The sample which is a woven or knitted fabric is loated with 1500 g and stood for 1 min. to measure the vertical length $L_2$ and the load is released and the stress is relaxed for 60 min. Further the loading of 5 g is repeated and stood for 1 min. to measure the vertical length $L_3$.

Stretching rate and stretching recovery are calculated by the following equations.

$$\text{Stretching rate (\%)} = \frac{L_2 - L_1}{L_1} \times 100$$

$$\text{Stretching recovery (\%)} = \frac{L_2 - L_3}{L_2 - L_1} \times 100$$

(3) Linear Shrinkage Percentage

This is measured according to JIS L 1015 7.15. (2) at 170° C. for 15 min. with initial load = denier × 50.

(4) Number of Crimp

This is measured according to JIS L 1015 7.12.1.

(5) Percentage of Crimp

This is measured according to JIS L 1015 7.12.2.

(6) Denier

This is measured according to JIS L 1015 7.5.1A.

(7) Strength and Elongation

This is measured according to JIS L 1015 7.7.1.

(8) Birefringence

This is measured by a polarization microscope equipped with a beleck compensator with use of tricresyl phosphate as the dipping solution.

(9) Density of Spun Yarn

There is used the following values measured by a density gradient tube.

| | |
|---|---|
| Cotton | 1.5 |
| Rayon | 1.5 |
| Wool | 1.32 |
| Silk | 1.39 |
| Polyester | 1.38 |
| Hemp | 1.50 |
| Polyester conjugate fiber according to the present invention | 1.38 |

As the blending ratio, a weighted mean with the mixing ratio is used.

PREPARATION OF POLYESTER CONJUGATE FIBERS

Preparation 1

A polyethylene terephthalate copolymer in which 2.5 mol % of 5-sodium sulfo-isophthalic acid was compolymerized and had an intrinsic viscosity of 0.529 was used as component A, and a polyethylene terephthalate having an intrinsic viscosity of 0.634 was used as component B. An un-drawn yarn was prepared by conjugate-spinning these components in side by side of a volume ratio of 1:1 at 290° C. and drawn to 2.4 ratio. The drawn yarn was annealed under tension at 160° C. and then mechanically crimped. The resultant polyester conjugate fiber (C-1) of 2.2 denier and 51 mm cut length had a strength of 3.3 g/d, an elongation of 55%, a crimp number of 11/inch, a crimpness of 19% and a birefringence of $95 \times 10^{-3}$.

Preparation 2

A polyethylene terephthalate copolymer in which 5.1 mol % of 5-sodium sulfo-isophthalic acid was compolymerized and had an intrinsic viscosity of 0.47 was used as component A, and a polyethylene terephthalate having an intrinsic viscosity of 0.685 was used as component B. An un-drawn yarn was prepared by conjugate-spinning these components in side by side of a volume ratio of 1:1 at 285° C. and drawn to 2.5 ratio. The drawn yarn was annealed under tension at 150° C. and then mechanically crimped. The resultant polyester conjugate fiber (C-2) of 4.0 denier and 51 mm cut length had a strength of 2.0 g/d, an elongation of 71.5%, a crimp number of 9.2/inch, a crimpness of 18% and a birefringence of $105 \times 10^{-3}$.

Preparation 3

A polyethylene terephthalate copolymer in which 2.3 mol % of 5-sodium sulfo-isophthalic acid and 3.2 mol % of butanediol were compolymerized and had an intrinsic viscosity of 0.463 was used as component A, and a polybutylene terephthalate having an intrinsic viscosity of 0.660 was used as component B. An un-drawn yarn was prepared by conjugate-spinning these components in side by side of a volume ratio of 0.9:1.0 at 280° C. and drawn to 2.6 ratio. The drawn yarn was annealed under tension at 145° C. and then mechanically crimped. The resultant polyester conjugate fiber (C-3) of 3.0 denier and 64 mm cut length had a strength of 2.5 g/d, an elongation of 52%, a crimp number of 10/inch, a crimpness of 20% and a birefringence of $134 \times 10^{-3}$.

Preparation 4

A polyethylene terephthalate copolymer in which 2.9 mol % of 5-sodium sulfo-isophthalic acid was compolymerized and had an intrinsic viscosity of 0.450 was used as component A, and a polyethylene terephthalate copolymer in which 4 mol % of isophthalic acid was compolymerized and had an intrinsic viscosity of 0.660 was used as component B. An un-drawn yarn was prepared by conjugate-spinning these components in hollow side by side at 290° C. and drawn to 2.6 ratio. The drawn yarn was annealed under tension at 160° C. and then mechanically crimped. The resultant polyester conjugate fiber (C-4) of 6.5 denier and 64 mm cut length had a strength of 3.0 g/d, an elongation of 56%, a crimp number of 9/inch, a crimpness of 21%, a hollowness of 24% and a birefringence of $158 \times 10^{-3}$.

HEAT-TREATMENT FOR FABRICS

Treatment 1

This treatment is carried out with use of the equipment shown in FIG. 1, in which a rolled raw non-woven fabric (D) set on a delivery roller (1) in supply zone (I) of the fabric is overfed to the shooter (3) through feed rollers (2) and overfed continuously on a bar conveyor (5) having bars arranged at equal spaces at the outlet of a shooter (3).

The bar conveyor (5) runs endlessly by rotation of conveyor chain wheels (4) and air blow pipes (6) equipped weftwise parallel below the upper portion of the bar conveyor (5) blows an appropriate amount of air. The raw non-woven fabric (D) forms an uniform peak in lateral direction by the air blow so that the feeding amount in the direction of progress (longitudinal direction) is controlled constant.

The raw non-woven fabric (D) passed on the air blow pipe (6) forms a short loop of a definite length between the bars and is sent to the subsequent heat treating zone (II). Far-infrared ray irradiation plates (7) are arranged above and below the bar conveyor (5) in the heat treating zone (II) and the distance between each far-infrared ray irradiation plate (7) and the bar conveyor can be varied appropriately and also the temperature can be controlled by a voltage controller.

The non-woven fabric (D) entered into the heat treating zone (II) absorbs radiation of wave length 3 to 50 μm in the spectrum range of far-infrared ray to give a molecular vibration so that the non-woven fabric (D) is heated internally and shrunk rapidly in both of longitudinal and lateral directions at the same time. As a result, the non-woven fabric (D) having a short loop on the bar conveyor (5) in the longitudinal direction becomes flat as the shrinkage proceeds and the lateral shrinkage also goes on to complete the shrinking process.

Then the non-woven fabric passed through the heat treating zone (II) is cooled with air blown from the air blow pipe (6) equipped below the bar conveyor (5) at outlet of the heat treating zone (II), dropped on a shooter box (8) and then put between nip rollers (9) of the take-up zone (III) and wound on a take-up roller (10).

Treatment 2

Figure 2:
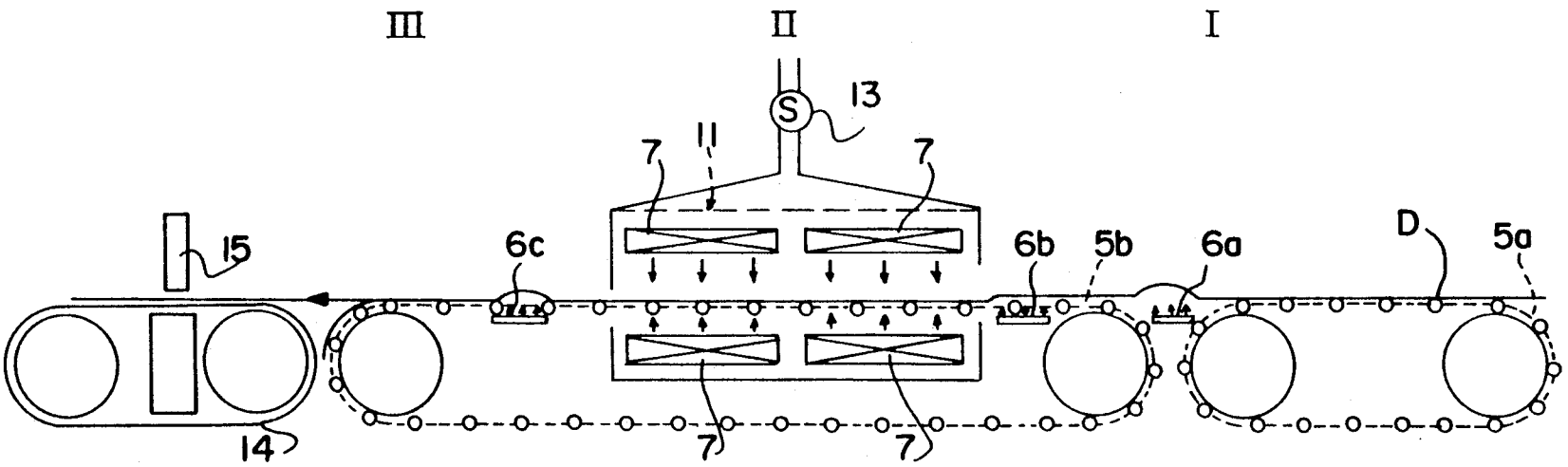

This treatment is carried out with use of the equipment shown in FIG. 2, in which a non-woven fabric (D) fed to an overfeed conveyor (5*a*) in supply zone (I) of the non-woven fabric is floated by air blown from air blow plates (6*a*) and (6*b*) approx. 1 cm over the conveyor. The bar conveyor (5*a*) of supply zone (I) moves faster than the bar conveyor (5*b*) of heat treating zone (II) and thus an overfeed corresponding to the warpwise shrinkage of the non-woven fabric (D) in heat treating zone (II) is accomplished.

Next, far-infrared ray irradiation plates (7) are arranged above and below the bar conveyor (5*b*) in heat treating zone (II), in which the distance between each far-infrared ray irradiation plate (7) and the bar conveyor (5*b*) can be varied appropriately and also the temperature can be controlled by a voltage controller.

Further, suction holes (11), a suction duct (12) and a suction fan (13) are equipped in the upper portion of heat treating zone (II) to float the non-woven fabric over the bar conveyor (5*b*) by approx. 2 mm by suctioning and thus to ease the shrinkage movement of the non-woven fabric.

Thus, the raw non-woven fabric (D) entering heat treating zone (II) absorbs radiation of wave length 3 to 50 μm in the spectrum range of far-infrared ray to give a molecular vibration so that the non-woven fabric is internally heated and shrinks rapidly in both the longitudinal and lateral directions at the same time. As a result, the raw non-woven fabric (D) moves uniformly in both directions as the shrinkage proceeds to complete the shrinking process. The non-woven fabric passed through heat treating zone (II) is cooled by air blown from a cooling air blow plate (6*c*) and then transferred to a plate conveyor (14) and cut by a cutter (15) to a required shape.

Treatment 3

Figure 3:
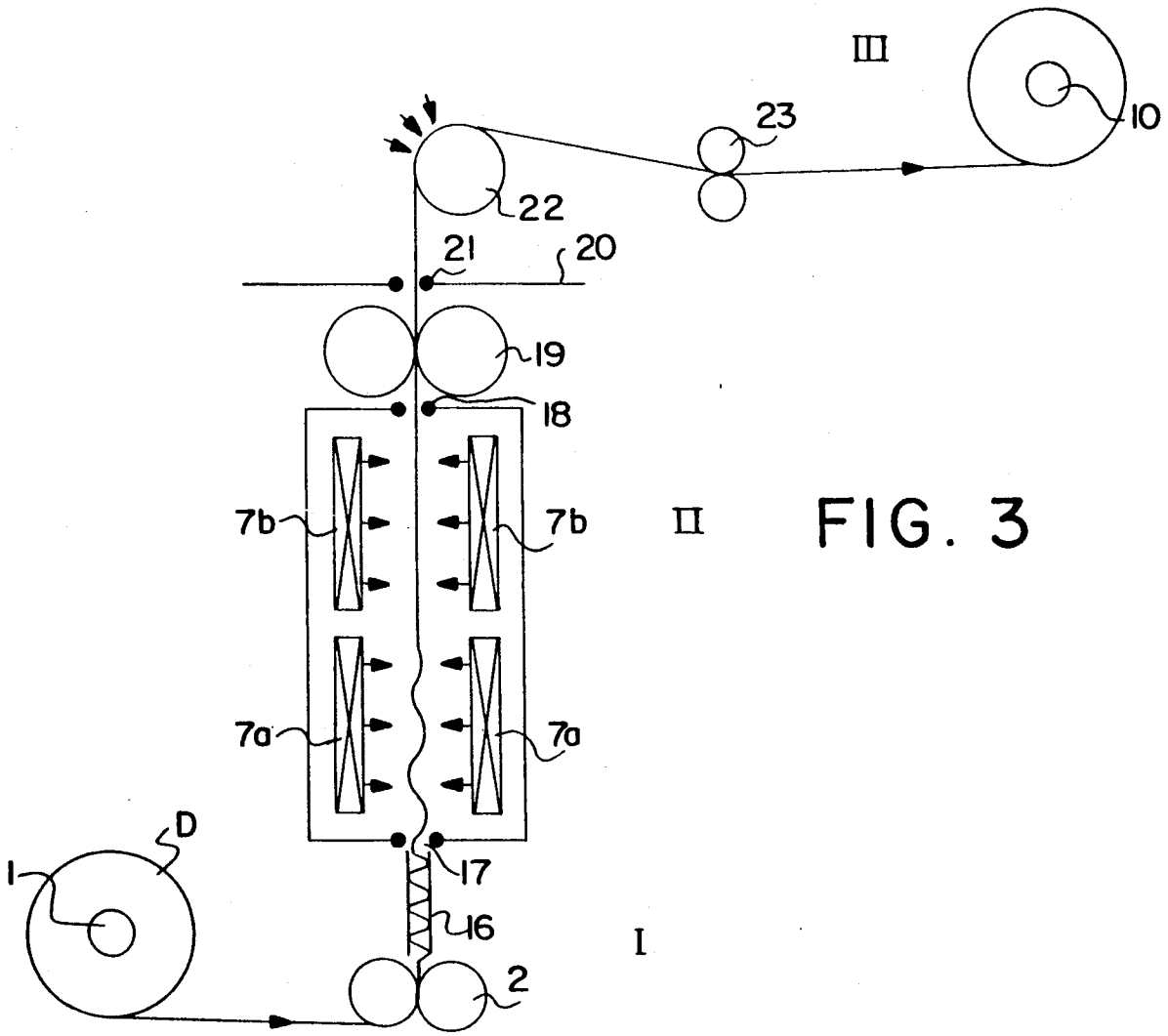

This treatment is carried out with use of the equipment shown in FIG. 3, in which a rolled raw non-woven fabric (D) set on a delivery roller (1) in supply zone (I) of the non-woven fabric is overfed through a feed roller (2) to a rough loop-holding grid (16) coated by Teflon. The raw non-woven fabric (D) is passed through inlet guide rods (17) of heat treating zone (II), through far-infrared ray irradiation plates (7) and then through outlet guide rods (18) and pressed to an appropriate thickness by hot rollers (19) to give a smooth surface. Further, the non-woven fabric (D) is passed through between guide rods (21) of a heat insulating plate (20), sucked on a suction cooling drum (22) to be air-cooled, then held by nip rollers (23) of take-up zone (III) and wound by a take-up roller (10). In heat treating zone (II), the raw non-woven fabric (D) is sent upward between the far-infrared ray irradiation plates (7) equipped vertically by floating power of an ascending air current and uniformly absorbs radiation of a wave length of 3 to 50 μm in the spectrum range in the far-infrared ray irradiation plates (7) from both sides under a relaxed state to give molecular vibration so that the non-woven fabric (D) is internally heated and rapidly shrinks in both directions at the same time.

The surface temperature of the lower far-infrared ray irradiation plates (7*a*) is set lower than that of the upper far-infrared ray irradiation plates (7*b*) to prevent a sudden high shrinkage. The distance between the paired far-infrared ray irradiation plates (7*a*) or (7*b*) can be varied. In the vertical heat treating zone of this type, nothing inhibits the irradiation of the far-infrared ray and a uniform shrinkage in both directions can be completed continuouly.

An overfeeding corresponding to the shrinkage is provided continuously by giving a difference between peripheral velocities of the suction drum (22) and the feed roller (2) and the raw non-woven fabric (D) is held in a looped state in the loop-holding grid (16) and is ready for the subsequent step. The hot roller (19) is rotated in the same peripheral velocity as the suction drum (22), but in some cases it is uncoupled for disuse. As air is heated with the far-infrared ray irradiation plates (7*a*) and (7*b*) to generate an ascending air current, the heat insulating plate (20) is provided to prevent its entry into the subsequent portion comprising the suction cooling drum (22) and thus to give no difficulty on cooling the non-woven fabric.

Treatment 4

Figure 4:
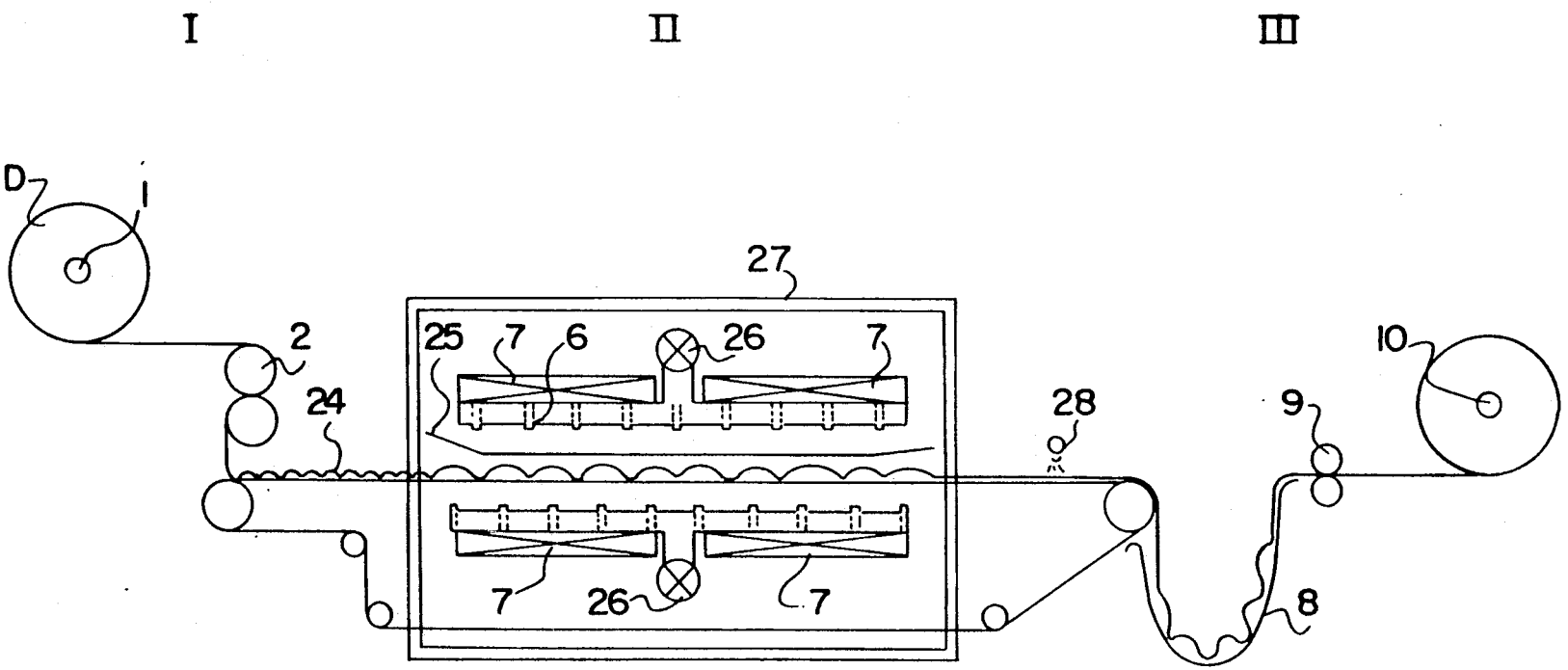
Figure 5:
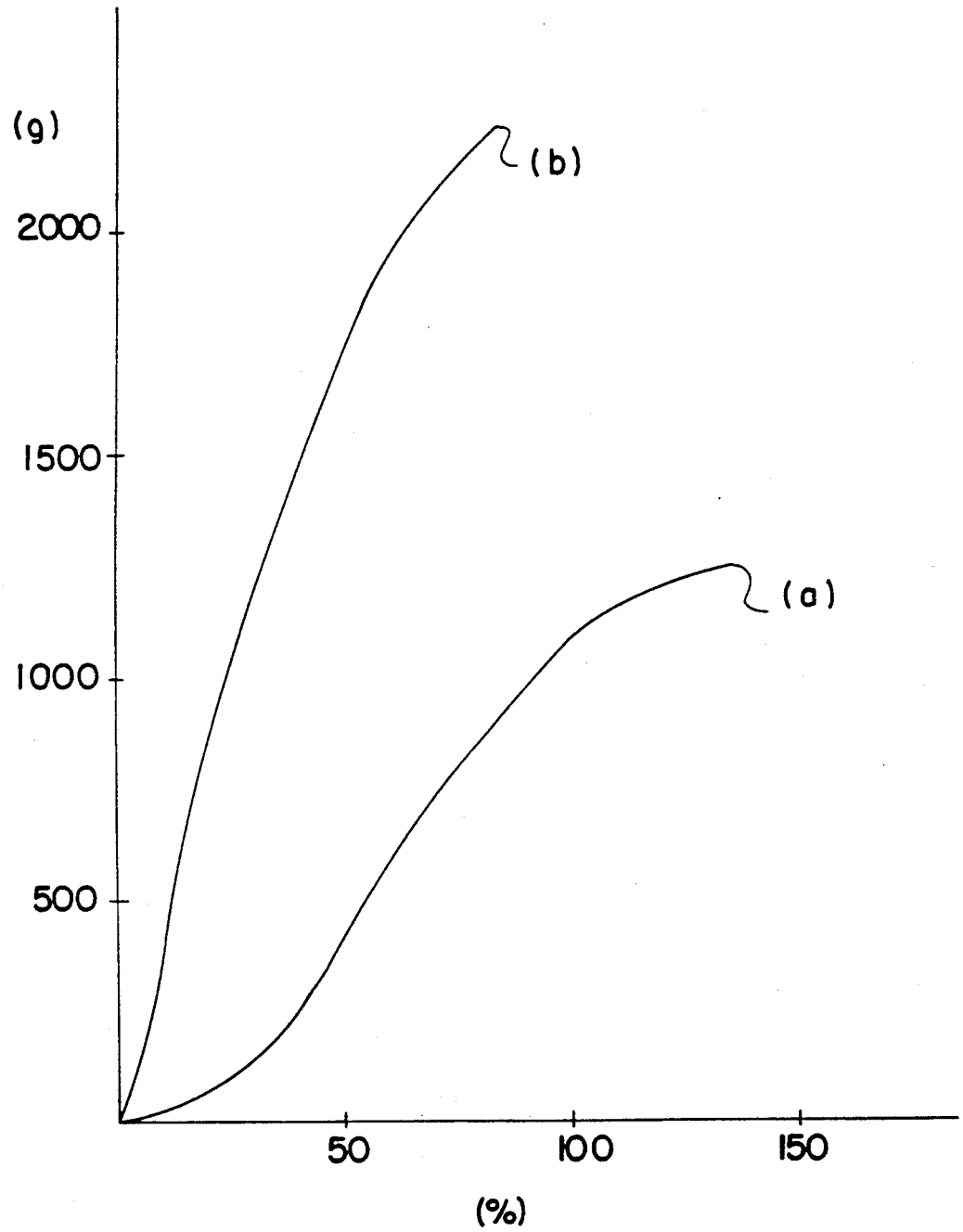
FIG. 5 shows a load-stretching rate curve of the non-woven fabric in an example of the present invention.

This treatment is carried out with use of the equipment shown in FIG. 4, in which a rolled raw fabric (D) set on a delivery roller (1) in supply zone (I) of the fabric is overfed on a net conveyor (24) through a feed roller (2).

The net conveyor (24) runs endlessly and an upper net (25) is arranged above it. Far-infrared ray irradiation plates (7) are arranged in the back of each net and it is controlled by adjusting the surface temperature by voltage controlling with use of a temperature sensor in the heat treating chamber.

Air blow pipes (6) are arranged between each element of the far-infrared ray irradiation plates (7) parallel to the width direction (weft direction) and always take an appropriate amount of air of the heat treating chamber (27) and blows it. This air forms a short loop of the raw fabric between the two nets.

The raw fabric (D) entered to the heat treating zone (II) shrinks rapidly by the far-infrared ray irradiation. At this time, the warpwise raw fabric (D) which has formed a loop on the net conveyor (24) becomes flat as the shrinkage proceeds and also it shrinks weftwise to complete the shrinkage process. The fabric passed through the heat treating zone (II) is then cooled with air blown from the air cooling nozzle (28) equipped on the upper portion of the net conveyor (24) at the outlet of the heat treating zone (II) and dropped to the shooter box (8) and then put between the nip rollers (9) of the take-up portion (III) and wound on the take-up roller (10).

EXAMPLES OF STRETCH FABRICS

EXAMPLE 1

The polyester conjugate fiber (C-2) of 4.0 denier and 51 mm length prepared in Preparation 2 and a usual polyester staple of 3 denier and 51 mm cut length and a sheath & core type low-melting polyester of 2 denier and 51 mm cut length (Kanebo's Ester/cotton Bel-Combi type 4080) were mixed together to the blending ratio shown in Table 1, opened and blended in an opening machine, then pneumatically conveyed, carded in a carding machine and drawn by a drafter to obtain a cross web of a cross angle of 30°, a width of 1500 g/m$^2$ and a weight of 50 g/m$^2$. One side of the cross web was slightly needled (28 needles/cm$^2$) and wound in a roll form to obtain a raw non-woven fabric.

According to Treatment 1, this raw fabric was passed through the feed roller (2), overfed at the defined speeds as shown in Table 1, passed through the shooter (3), fed on the bar conveyor (5) at a rate of 5 m/min., then passed on the air blow pipe to form a short loop and then sent to the heat treating zone (II) for far-infrared irradiation. The temperature in the heat treating zone (II) was set at 110° C. and the distance between the far-infrared ray irradiation plates (7) was set at 12 cm. The heat treating period was set at 17 sec.

The non-woven fabric passed through the heat treating zone (II) was cooled with the air blow pipe (6) equipped on the outlet side and then dropped to the shooter box (8) and put between the nip rollers (9) and wound continuously on the take-up roller (10). The physical properties of the resultant stretch non-woven fabrics are shown in Table 2. The results for comparative samples which were obtained in the same manner as in the samples 1 and 2 except that the heat treatment was carried out with a hot air shrink drier are also shown in Table 2 as Controls 1 and 2.

TABLE 1

| Sample No. | Blending composition (weight %) Polyester conjugate yarn | Polyester staple | Low-melting polyester | Weight g/m$^2$ | Over-feeding rate (%) |
|---|---|---|---|---|---|
| 1 | 90 | 0 | 10 | 52 | 45 |
| 2 | 85 | 5 | 10 | 49 | 35 |
| 3 | 80 | 10 | 10 | 51 | 27 |
| 4 | 70 | 20 | 10 | 49 | 19 |
| 5 | 50 | 40 | 10 | 53 | 13 |
| 6 | 30 | 60 | 10 | 48 | 8 |

TABLE 2

| Sample No. | Shrinkage (%) Lon. | Shrinkage (%) Lat. | Stretching rate (%) Lon. | Stretching rate (%) Lat. | Stretching recovery (%) Lon. | Stretching recovery (%) Lat. | Tensile strength (%) Lon. | Tensile strength (%) Lat. | Birefringence after heat treatment |
|---|---|---|---|---|---|---|---|---|---|
| 1 | 45 | 43 | 37 | 34 | 97 | 99 | 1320 | 1210 | $117 \times 10^{-3}$ |
| 2 | 35 | 32 | 30 | 28 | 95 | 97 | 1645 | 1463 | $114 \times 10^{-3}$ |
| 3 | 27 | 25 | 25 | 23 | 92 | 93 | 1521 | 1408 | $116 \times 10^{-3}$ |
| 4 | 19 | 17 | 15 | 13 | 85 | 86 | 1635 | 1325 | $118 \times 10^{-3}$ |
| 5 | 13 | 12 | 13 | 12 | 84 | 83 | 1782 | 1139 | $115 \times 10^{-3}$ |
| 6 | 8 | 8 | 11 | 10 | 78 | 77 | 2304 | 1912 | $118 \times 10^{-3}$ |
| Control 1 | 1 | 45 | 6 | 36 | 72 | 89 | 1450 | 1361 | $119 \times 10^{-3}$ |
| Control 2 | 0 | 34 | 4 | 31 | 74 | 85 | 1705 | 1508 | $120 \times 10^{-3}$ |

Note.
Lon. means longitudinal direction.
Lat. means lateral direction.

EXAMPLE 2

The polyester conjugate fiber (C-1) prepared in Preparation 1, which had 2.2 denier and 51 mm length, was opened by an opening machine, pneumatically conveyed, carded by a carding machine and then drawn by a drafter to obtain a cross web of a cross angle of 40°, a width of 1500 mm and a weight of 25.1 g/m$^2$. This web was immersed in an aqueous acrylic resin emulsion being a well known chemical binder, and then squeezed with a roller to pick up 5% resin based on the fiber weight and the moisture was removed continuously at 95° C. and the web was wound to get a raw non-woven fabric (D).

This non-woven fabric raw cloth (D) was continuously treated according to Treatment 3. The peripheral velocity ratio of the feed roller (2) to the suction cooling drum (22) was adjusted to give an overfeeding rate of 34% and the peripheral velocity of the suction cooling drum (22) was set at 3 m/min. Further, the distance between the opposing two far-infrared ray irradiation plates (7*a*) and (7*b*) was set at 12 cm and the temperature in the heat treating zone (II) was always controlled at 125° C. by adjusting the voltage of the back side of irradiation plates with the thyristor connected to the central sensor and the heat treatment period was 15 sec. The hot roller (19) at the outlet of the heat treating zone was set uncoupled for disuse.

The heat treated non-woven fabric was cooled by the suction cooling drum (22), passed through the nip roller (23) and wound continuously to the take-up roller (10). Multipore air blow pipes were equipped to the inlet guide rod (17) and the outlet guide rod (18) of the heat treating zone (II) and air was blown slowly from them to both sides of the non-woven fabric at a right angle to effect the heat transfer prevention and the rapid cooling after the heat treatment respectively.

The resultant non-woven fabric had a longitudinal shrinkage of 34% and a lateral shrinkage of 35%. It showed a longitudinal stretching rate of 46% and a lateral stretching rate of 47% and the birefringence of the fiber was $104\times10^{-3}$.

The same non-woven fabric, which was heat-treated at 160° C. for 4 sec. with a well known short loop drier, showed a longitudinal shrinkage of 2% and a longitudinal stretching rate of 5% and the birefringence of the polyester conjugate yarn was $126\times10^{-3}$.

EXAMPLE 3

50 weight % of the polyester conjugate fiber (C-4) prepared by Preparation 4, which had 6 denier and 64 mm cut length, 35 weight % of wool and 15 weight % of a sheath & core type polyester fiber having 4 denier and 64 mm cut length (melting point of the core: 225° C., melting point of the sheath: 95° C.) were blended and opened with an opening machine, then pneumatically conveyed, carded in a carding machine and pressed by a roller.

Thus, a laminated cross web of 2000 mm width and 420 g/m$^2$ weight was prepared continuously in a rate of 6 m/min. and it was used as the raw non-woven fabric. In this Example, the manufacturing equipment of the non-woven fabric was connected directly to the equipment for Treatment 2 to supply the continuously manufactured raw non-woven fabric (D) on the overfeed conveyor (6*a*) subsequently. The overfeeding rate between the bar conveyor (6*a*) and the overfeed conveyor (6*b*) was set at 53%.

The distance between the far-infrared ray irradiation plates (7) was set at 14 cm and the temperature in the heat treating zone (II) was maintained at 110° C. by on-off control of the electric power source behind the irradiation plates with the central sensor. The heat treatment period was 17 sec.

The heat-treated non-woven fabric was cooled by the air from the air blow plate (6*c*), transferred to the plate conveyor (14) in after-treatment zone (III) and cut with the cutter (15) to be shaped to a defined shape, in which a rotary blade was applied warpwise and a guillotine blade was applied weftwise. The distance between bars in the bar conveyor (5*b*) was 80 mm and the diameter of the bar was 5 mm.

The resultant non-woven fabric showed a longitudinal shrinkage of 53%, a lateral shrinkage of 33%, a longitudinal stretching rate of 12% and a lateral stretching rate of 10%. The birefringence of the polyester conjugate yarn in the non-woven fabric was $154\times10^{-3}$.

EXAMPLE 4

80 weight % of the polyester conjugate fiber (C-3) of 3.0 denier and 64 mm cut length prepared by Preparation 3, 20 weight % of 6 nylon of 2.0 denier and 64 mm cut length were blended and opened by an opening machine, then pneumatically conveyed and carded by a carding machine. The resultant web was blown on the mesh cylinder and sucked to obtain a random web. The random web was needle-punched in the condition of 24 needles/cm$^2$ and a needle depth of 8 mm to obtain a raw non-woven fabric (D) of 60 g/m$^2$.

This fabric was passed through the delivery roll (1) and continuously treated according to Treatment 3, in which the overfeed rate of the fabric was set at 26% by controlling the peripheral velocity ratio of the feed roller (2) against the suction cooling drum (22) and the peripheral velocity of the suction cooling drum (22) was operated at 3 m/min.

The distance between the opposing far-infrared ray irradiation plates (7*a*) and (7*b*) was set at 12 cm and the temperature in the heat treating zone (II) was controlled at 130° C. by controlling the voltage behind the irradiation plate by the thyristor connected to the central sensor. The heat treatment period was 15 sec.

The surface temperature of the hot rollers (19) at the outlet of the heat treating zone was set at 130° C. and the fabric was pressed by them to make the surface smooth. The peripheral velocity of the hot rollers (19) was set at the same level as that of the suction cooling drum (22).

The heat treated non-woven fabric was cooled in the suction cooling drum (22), passed through the nip roller (23) and wound continuously by the take-up roll (10).

The resultant non-woven fabric showed a longitudinal shrinkage of 26%, a lateral shrinkage of 53.6%, a longitudinal stretching rate of 31% and a lateral stretching rate of 42%. The birefringence of the polyester conjugate yarn in the non-woven fabric was $136\times10^{-3}$.

The longitudinal load-stretching rate curve of this non-woven fabric is shown in FIG. 4 as (a). The longitudinal load-stretching rate curve of the non-woven fabric prepared by a same method using 18% of the polyester conjugate fiber and 82% of 6-nylon is shown in FIG. 4 as (b).

EXAMPLE 5

A noncrimp short cut fiber of 10 mm cut length, which was prepared by cutting the drawn tow prepared in Preparation 1, had a birefringence of $96\times10^{-3}$. 70 parts of this fiber, 30 parts of a polyester fiber of 0.8 denier and 5 mm cut length, 15 parts of a sheath & core low-melting polyester of 2 denier and 5 mm cut length (Kanebo's Ester/Cotton Bel-Combi type 4080) and 10 parts of a dispersant for paper-making were added to 100,000 parts of water and dispersed in it. Then the dispersion was flowed on a moving mesh net in a constant rate to remove water by suction to obtain a raw non-woven fabric (D).

The manufacturing equipment of the raw non-woven fabric (D) was directly connected to the equipment of Treatment 1 and the raw non-woven fabric (D) was continuously fed on the bar conveyor (5) of a bar diameter of 5 mm and a bar distance of 70 mm at a rate of 5 m/min. and an overfeed rate of 36% and supplied to the heat treating zone (II) while forming a short loop.

The heat treatment in the heat treating zone (II) was carried out in a condition that the temperature of the zone was 130° C., the distance between the far-infrared irradiation plates (7) was 12 cm and the heat treating period was 17 sec.

The non-woven fabric passed through the heat treating zone (II) was cooled by the air blow pipe (6) equipped on the outlet side, then dropped to the shooter box (8), put between the nip rollers (9) and wound continuously to the take-up roller (10).

The resultant non-woven fabric had a weight of 60 g/m$^2$, a longitudinal stretching rate of 36% and a lateral stretching rate of 32% and the birefringence of the polyester conjugate yarn was $115\times10^{-3}$.

EXAMPLE 6

84 parts of a polyester conjugate fiber (C-1) of 2.2 denier and 51 mm length, which was prepared in Preparation 1, and 16 parts of a sheath & core fiber of the blend ratio of 1:1 of 2.0 denier and 51 mm length, in which the core was a polyethylene terephthalate and the sheath was a polyethylene terephthalate copolymer containing 16% isophthalic acid component, were mixed and blended, carded, drawn, roved, and fine-spun to obtain a spun yarn of English count of 30'S/1. It was used as the weft yarn. On the other hand, this spun yarn was beamed and sized to obtain the warp yarn. A gray fabric of a warp density of 35 yarns/inch, a weft density of 35 yarns/inch and 44 inch wide was prepared from them.

The fabric was scoured at 90° C. for 30 min., dried and heat treated according to Treatment 4. The overfeed rate was set at 45% and the speed of the net conveyor was set at 10 m/min and the fabric was passed above the air blow pipe to form a short loop and sent to the far-infrared irradiation zone (II).

The temperature in the heat treating zone was 150° C. and the heat treatment period comprising drying process was 60 sec. The fabric passed through the heat treating zone (II) was cooled by the air cooling nozzle equipped on the outlet side and then dropped in the shooter box (8) and put between the nip rollers (9) and wound continuously by the take-up roller (10).

The resultant woven fabric had a warp shrinkage of 35%, a weft shrinkage of 38%, a warp stretching rate of 29% and a weft stretching rate of 30%. The birefringence of the polyester conjugate yarn of the fabric was $155\times10^{-3}$.

EXAMPLE 7

84 parts of a polyester conjugate fiber (C-1) of 2.2 denier and 51 mm length prepared in Preparation 1 and 16 parts of a polybutylene terephthalate fiber of 3.0 denier and 51 mm length were mixed and blended, carded, drawn, roved, and fine-spun to obtain a spun yarn of English count of 30'S/1. It was made into a two ply yarn, which was used as the warp and the weft to prepare a twill fabric at a warp density of 64 yarns/inch and a weft density of 58 yarns/inch. The void percentage of the warp was 61.7% and the void percentage of the weft was 64.7%.

The fabric was scoured at 95° C. for 20 min., dried and then dyed in stream at 120° C. for 60 min. After drying, the dyed fabric was treated according to Treatment 4, in which the overfeed rate was set at 26%, the net conveyor speed was set at 10 m/min and the fabric was passed above the air blow pipe to form a short loop and sent to the far-infrared irradiation zone.

The fabric passed through the heat treating zone (II) at 150° C. for 45 sec. was cooled by the air cooling nozzle equipped on the outlet side and then dropped in the shooter box (8) and put between the nip rollers (9) and wound continuously by the take-up roller (10).

The resultant woven fabric had a warp shrinkage of 23%, a weft shrinkage of 25%, a warp stretching rate of 17% and a weft stretching rate of 19% and a weight of 268 g/m$^2$. The birefringence of the polyester conjugate yarn of the fabric was $157\times10^{-3}$. The stitch slipping resistance under 12 kg load according to JIS L 1096 B method was 1.8 mm in both directions.

EXAMPLE 8

The polyester conjugate fiber (C-1) of 2.2 denier and 51 mm length was opened and picked, carded, drawn, roved, spun to give a spun yarn of English count of 20'S/1. It was mixed with 100% cotton spun yarn of 20'S/1 in a ratio of 1:1 and a dappled face knitted fabric was prepared using a 18 gauge round knitting machine. The weight of the knitted fabric was 130 g/m$^2$.

The fabric was scoured, bleached with hydrogen peroxide, dyed in stream at 120° C. for 60 min. with a fluorescent dye, centrifugally dehydrated, cut and opened and then heat-treated according to Treatment 4.

The overfeed rate was set at 20% and the speed of the net conveyor was set at 5 m/min and the fabric was passed above the air blow pipe to form a short loop and sent to the far-infared irradiation zone.

The fabric passed through the heat treating zone (II) at 160° C. for 45 sec. was cooled by the air cooling nozzle equipped on the outlet side, dropped in the shooter box (8), put between the nip rollers (9) and wound continuously by the take-up roller (10).

The resultant knitted fabric had a wale shrinkage of 18.2%, a course shrinkage of 15.7%, a wale stretching rate of 3.5% and a course stretching rate of 60.8% and a weight of 198 g/m$^2$. The birefringence of the polyester conjugate yarn of the fabric was $155\times10^{-3}$.

INDUSTRIAL APPLICABILITY OF THE INVENTION

Each of the fabrics according to the present invention has a stretching property of at least 9% in both of the longitudinal and lateral directions and good feeling, and is superior in dying property and heat set property. Accordingly, they can be very effectively used for both clothings and industrial materials.

What is claimed is:

1. A method for the preparation of a fabric which has a stretching rate in both of the longitudinal direction and the lateral direction within the following range:

$$9 \leqq \frac{L_2 - L_1}{L_1} \times 100 \leqq 160$$

wherein $L_1$ is the vertical length of a specimen of a definite length and 5 cm wide when loaded by 5 g weight and $L_2$ is the vertical length of said specimen when loaded by a given weight, which is 240 g when said fabric is non-woven fabric and 1500 g when said fabric is woven or knitted fabric, characterized in preparing by fiber intermingling, weaving or knitting a raw fabric comprising a polyester conjugate fiber having a birefringence of $85\times10^{-3}$ to $190\times10^{-3}$ in an amount of at least 30 weight % and a crimp number of 8 to 13/inch, which is produced by conjugate spinning a polyethylene terephthalate (component A) copolymerized with a structural unit having a metal sulfonate group in a ratio of 1.5 to 6.0 mol % and a polyethylene terephthalate or polybutylene terephthalate (component B) in side by side method, drawing the product, and mechanically crimping the fiber to a crimp number of 8 to 13/inch, and irradiating the raw fabric with far-infrared rays in a relaxed condition to proceed three-dimensional crimping of said conjugate fiber to produce a stretch fabric comprising said conjugate fiber having a birefringence of $90\times10^{-3}$ to $195\times10^{-3}$.

2. A method according to claim 1, wherein the number of crimp of said conjugate fiber is increased to 30 to 50/inch by said far-infrared irradiation.

3. A method according to claim 1, wherein said raw fabric is supplied to the heat treatment process in a manner of forming a short loop.

4. A method according to claim 3, wherein the initial temperature of the heat treatment process is not higher than 70° C.

5. A method according to claim 1, wherein said raw fabric contains 5 to 35 weight % of a low-melting fiber.

6. A method according to claim 1, wherein said fabric is a woven fabric having a void percentage of at least 50% in the condition of loading weight of 1500 g to 5 cm width of said fabric in each of the longitudinal direction and the lateral direction, said percentage of void being indicated by the following equation:

$$\text{void percentage} = \left(1 - \frac{0.034}{\sqrt{N \cdot S}} \times P\right) \times 100$$

wherein N is English count converted to single fiber, S is density of the spun yarn (g/cm$^2$) and P is punching density per inch.

7. A method according to claim 6, wherein said void percentage is within the range of 53 to 72%.

8. A two-way stretch fabric produced according to the method of claim 1.

* * * * *